US010803849B2

(12) United States Patent
Maeda

(10) Patent No.: US 10,803,849 B2
(45) Date of Patent: Oct. 13, 2020

(54) SOUND PRESSURE SIGNAL OUTPUT APPARATUS, SOUND PRESSURE SIGNAL OUTPUT METHOD, AND PROGRAM FOR SOUND PRESSURE SIGNAL OUTPUT

(71) Applicant: SOUND DESIGN LAB LLC, Iwata-shi (JP)

(72) Inventor: Osamu Maeda, Iwata (JP)

(73) Assignee: SOUND DESIGN LAB LLC, Iwata-shi (JP)

( * ) Notice: Subject to any disclaimer, the term of this patent is extended or adjusted under 35 U.S.C. 154(b) by 0 days.

(21) Appl. No.: 16/620,163

(22) PCT Filed: Apr. 13, 2018

(86) PCT No.: PCT/JP2018/015539
§ 371 (c)(1),
(2) Date: Dec. 6, 2019

(87) PCT Pub. No.: WO2019/198230
PCT Pub. Date: Oct. 17, 2019

(65) Prior Publication Data

US 2020/0135168 A1 Apr. 30, 2020

(51) Int. Cl.
*G10K 15/02* (2006.01)

(52) U.S. Cl.
CPC ..... *G10K 15/02* (2013.01)

(58) Field of Classification Search
CPC ..... G10K 15/04; G10K 15/02; H04R 5/04
USPC ..... 381/61, 86
See application file for complete search history.

(56) References Cited

U.S. PATENT DOCUMENTS

2004/0170288 A1* 9/2004 Maeda ..... G10K 15/02 381/86
2009/0325700 A1* 12/2009 Maeda ..... G10K 15/02 463/35

FOREIGN PATENT DOCUMENTS

JP 4079518 B2 4/2008
JP 4282786 B2 6/2009

OTHER PUBLICATIONS

International Search Report dated Jul. 10, 2018, issued for PCT/JP2018/015539.

* cited by examiner

*Primary Examiner* — Melur Ramakrishnaiah
(74) *Attorney, Agent, or Firm* — Locke Lord LLP

(57) ABSTRACT

The present invention provides a sound pressure signal output apparatus capable of synthesizing and outputting a sound pressure signal that simulates the sound of a real engine with reduced processing load in real time while flexibly adapting to specification changes. The sound pressure signal output apparatus comprises: an interface that acquires single sound data corresponding to the sound generated by one cylinder of a vehicle-mounted internal combustion engine during one combustion cycle in the cylinder, acquires order sound data corresponding to order sound for a frequency corresponding to the engine rotation speed, and acquires random sound data generated corresponding to at least either the material or the shape of the structure that makes up an engine; and a synthesis unit that synthesizes and outputs the sound pressure signal of an engine sound using the single sound data and the like acquired.

20 Claims, 15 Drawing Sheets

SOUND PRESSURE SIGNAL OUTPUT APPARATUS, SOUND PRESSURE SIGNAL OUTPUT METHOD, AND PROGRAM FOR SOUND PRESSURE SIGNAL OUTPUT

TECHNICAL FIELD

The present invention relates to a technical field of a sound pressure signal output apparatus, a sound pressure signal output method, and a program for sound pressure signal output. More specifically, the present invention relates to a technical field of a sound pressure signal output apparatus that synthesizes and outputs a sound pressure signal for an engine sound comparable to a sound generated from an internal combustion engine, a sound pressure signal output method, and a program for the sound pressure signal output apparatus.

BACKGROUND ART

In recent driving simulators and computer games, an engine sound generated along with traveling of a vehicle is output without traveling of an actual vehicle (that is, in a simulated manner). Note that, in the following description, the aforementioned driving simulators and computer games are referred to simply as "the driving simulators and the like". Conventionally, such a simulated engine sound is output by recording an engine sound generated by traveling of an actual vehicle and processing the recorded data in accordance with the state of the driving simulators and the like. However, processing the recorded data obtained by recording the actual engine sound has a problem in which there is a limit to matching to the state of the driving simulators and the like, which results in lack of realistic sensation and real-time property. Under such circumstances, conventionally, as in the inventions described in Patent Document 1 and Patent Document 2 listed below for example, a sound generated from one cylinder of an engine during one combustion cycle in the cylinder is repetitively reproduced in accordance with the number of cylinders and the rotation speed of the engine to synthesize and output a desired engine sound. Note that, in the following description, the aforementioned sound generated from one cylinder during one combustion cycle in the cylinder is referred to as "the single sound". More specifically, in the configuration according to each of the techniques disclosed in the patent documents, sound pressure signals for plural kinds of single sounds are prepared in accordance with the rotation speed of the engine and the accelerator opening (in other words, the degree of load to the engine), and the sound pressure signals are repetitively reproduced, synthesized, and output in accordance with the number of cylinders and the rotation speed of the engine as described above. Note that, in the following description, the rotation speed of the engine is arbitrarily referred to as "the rotation speed".

CITATION LIST

Patent Document

Patent Document 1: JP 4282786 B2
Patent Document 2: JP 4079518132

DISCLOSURE OF INVENTION

Problems to be Solved by the Invention

However, the technique disclosed in each of the above patent documents has a problem in which the sound pressure signals for the single sounds are required to be processed and synthesized under various conditions, and in which this puts high processing load on an apparatus performing the synthesis. The technique also has a problem in which it is impossible to promptly deal with a change of the engine specifications (for example, a combustion (explosion) interval or the like).

Under such circumstances, the present invention is accomplished by taking each of the above problems into consideration thereof, and an example of an object thereof is to provide a sound pressure signal output apparatus enabling a sound pressure signal for an engine sound resembling an actual engine sound to be output at low processing load and in real time in each of engines having various specifications, sound pressure signal output, and a program for the sound pressure signal output apparatus.

Solutions to the Problems

In order to solve the above problems, an invention according to claim 1 is characterized by comprising: a first acquisition means that acquires a single sound data, which is a sound data comparable to a sound generated from a cylinder of an internal combustion engine during one combustion cycle in the cylinder; a second acquisition means that acquires an order sound data, which is a sound data comparable to an order sound, frequency of which corresponds to a rotation speed of the engine; a third acquisition means that acquires a random sound data, which is a sound data comparable to a random sound generated to correspond to at least either a material or a shape of a structure constituting the engine due to operation of the engine; and a synthesis means that synthesizes sound pressure signal for the single sound data acquired, a sound pressure signal for the order sound data acquired, and a sound pressure signal for the random sound data acquired to output a sound pressure signal for a sound of the engine.

In order to solve the above problems, an invention according to claim 9 is characterized by a sound pressure signal output method of synthesizing and outputting a sound pressure signal for a sound of an internal combustion engine by means of a computer, comprising: a step of acquiring a single sound data, which is a sound data comparable to a sound generated from one cylinder of the engine during one combustion cycle in the cylinder; a step of acquiring an order sound data, which is a sound data comparable to an order sound, frequency of which corresponds to a rotation speed of the engine; a step of acquiring a random sound data, which is a sound data comparable to a random sound generated to correspond to at least either a material or a shape of a structure constituting the engine due to operation of the engine; and a step of synthesizing a sound pressure signal for the single sound data acquired, a sound pressure signal for the order sound data acquired, and a sound pressure signal for the random sound data acquired to output the sound pressure signal for the sound of the engine.

In order to solve the above problems, an invention according to claim 10 is characterized by causing a computer to execute: a step of acquiring a single sound data, which is a sound data comparable to a sound generated from one cylinder of an internal combustion engine during one combustion cycle in the cylinder; a step of acquiring an order sound data, which is a sound data comparable to an order sound, frequency of which corresponds to a rotation speed of the engine; a step of acquiring a random sound data, which is a sound data comparable to a random sound generated to correspond to at least either a material or a shape of a structure constituting the engine due to operation of the engine; and a step of synthesizing a sound pressure signal for the single sound data acquired, a sound pressure signal for the order sound data acquired, and a sound pressure signal for the random sound data acquired to output a sound pressure signal for a sound of the engine.

According to the invention described in any one of claims 1, 9, and 10, it is possible to synthesize and output a sound pressure signal for an engine sound resembling an actual engine sound at low processing load and in real time while flexibly dealing with a change of engine specifications.

An invention according to claim 2 is characterized by the sound pressure signal output apparatus according to claim 1, wherein the engine is a multi-cylinder engine, wherein the first acquisition means acquires the respective single sound data comparable to sounds respectively generated from the respective cylinders during the one combustion cycle in the respective cylinders, wherein the second acquisition means acquires the respective order sound data respectively corresponding to the respective cylinders, and wherein the synthesis means delays the sound pressure signals for the single sound data acquired and the sound pressure signals for the order sound data acquired to match a combustion interval among the respective cylinders and synthesizes the sound pressure signals for the respective single sound data, the sound pressure signals for the respective order sound data and the sound pressure signal for the random sound data to output the sound pressure signal for the sound of the engine.

According to the present invention, it is possible to synthesize and output a sound pressure signal for an engine sound more resembling an actual engine sound.

An invention according to claim 3 is characterized by the sound pressure signal output apparatus according to claim 2, wherein an amplitude magnification of at least either the sound pressure signal for the single sound data or the sound pressure signal for the order sound data differs per cylinder.

According to the present invention, it is possible to synthesize and output a sound pressure signal for engine sound data for generating an engine sound providing more realistic sensation.

An invention according to claim 4 is characterized by the sound pressure signal output apparatus according to any one of claims 1 to 3, wherein one of the single sound data comprises a plurality of single sound data by rotation speeds respectively corresponding to sounds generated during the combustion cycle at a plurality of different rotation speeds in the cylinder corresponding to the single sound data.

According to the present invention, it is possible to synthesize and output a sound pressure signal for engine sound data for generating an engine sound providing even more realistic sensation.

An invention according to claim 5 is characterized by the sound pressure signal output apparatus according to claim 4, wherein the synthesis means synthesizes the sound pressure signals for the plurality of single sound data with the sound pressure signal for the order sound data and the sound pressure signal for the random sound data while cross-fading the sound pressure signals for the plurality of single sound data based on the rotation speeds.

According to the present invention, it is possible to synthesize and output a sound pressure signal for an engine sound for generating an engine sound providing even more realistic sensation.

An invention according to claim 6 is characterized by the sound pressure signal output apparatus according to any one of claims 1 to 5, wherein, as for the order sound data, one of the order sound data is formed by an order sound data at time of acceleration and an order sound data at time of deceleration.

According to the present invention, it is possible to synthesize and output a sound pressure signal for an engine sound for generating an engine sound providing even more realistic sensation.

An invention according to claim 7 is characterized by the sound pressure signal output apparatus according to any one of claims 1 to 6, wherein the synthesis means controls for synthesis the sound pressure signal for the single sound data, the sound pressure signal for the order sound data, and the sound pressure signal for the random sound data based on accelerator opening and rotation speed corresponding to the driving.

According to the present invention, it is possible to synthesize and output a sound pressure signal for an engine sound for generating an engine sound providing even more realistic sensation.

An invention according to claim 8 is characterized by the sound pressure signal output apparatus according to any one of claims 1 to 7, wherein the synthesis means further synthesizes at least any of a sound pressure signal for idling sound data comparable to an idling sound corresponding to the engine, a sound pressure signal for starter sound data comparable to a starter sound corresponding to the engine, a sound pressure signal for gear sound data comparable to a gear sound corresponding to the engine, a sound pressure signal for gear shift sound data comparable to a gear shift sound corresponding to the engine, a sound pressure signal for rev limiter sound data comparable to a rev limiter sound corresponding to the engine, and a sound pressure signal for afterfire sound data comparable to an afterfire sound corresponding to the engine to output the sound pressure signal for the sound of the engine.

According to the present invention, it is possible to synthesize and output a sound pressure signal for an engine sound for generating an engine sound providing even more realistic sensation.

Effects of the Invention

According to the present invention, it is possible to synthesize and output a sound pressure signal for an engine sound resembling an actual engine sound at low processing load and in real time while flexibly dealing with a change of engine specifications.

EMBODIMENTS FOR CARRYING OUT THE INVENTION

Next, embodiments of the present invention will be described with reference to the drawings. Note that each of the embodiments described below is an embodiment to which the present invention is applied in a case in which a sound pressure signal for a sound generated from an internal combustion engine mounted in a vehicle is synthesized and output. Note that the aforementioned vehicle includes a vehicle such as an automobile and a motorcycle.

(I) First Embodiment

Figure 1A:
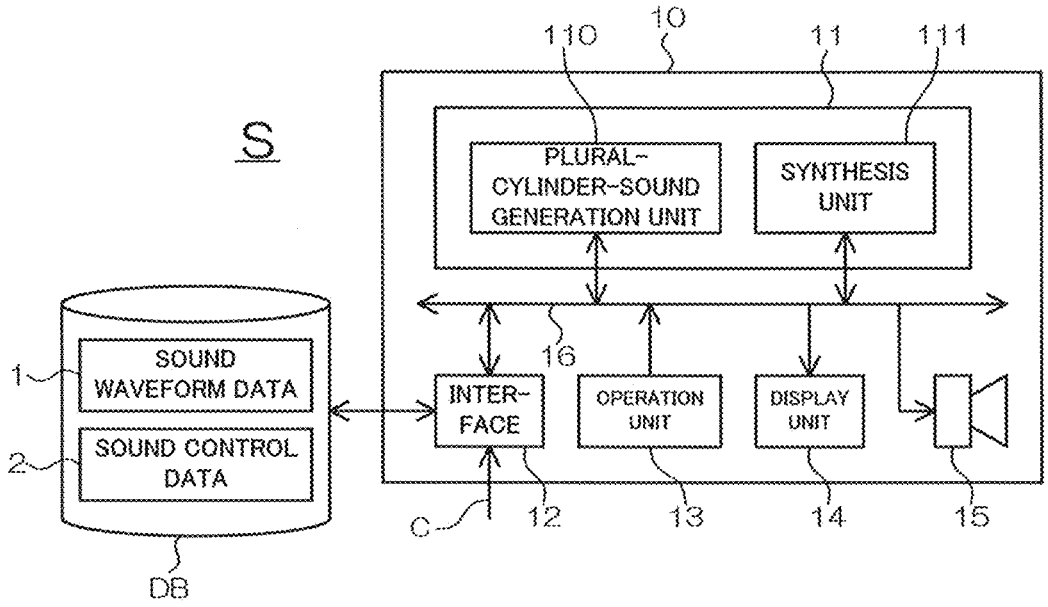
FIG. 1 is a block diagram and the like illustrating a schematic configuration of a sound pressure signal output apparatus according to a first embodiment, in which FIG. 1(*a*) is the block diagram, and in which FIG. 1(*b*) describes an overview of sound signal output processing in the sound pressure signal output apparatus.
Figure 1B:
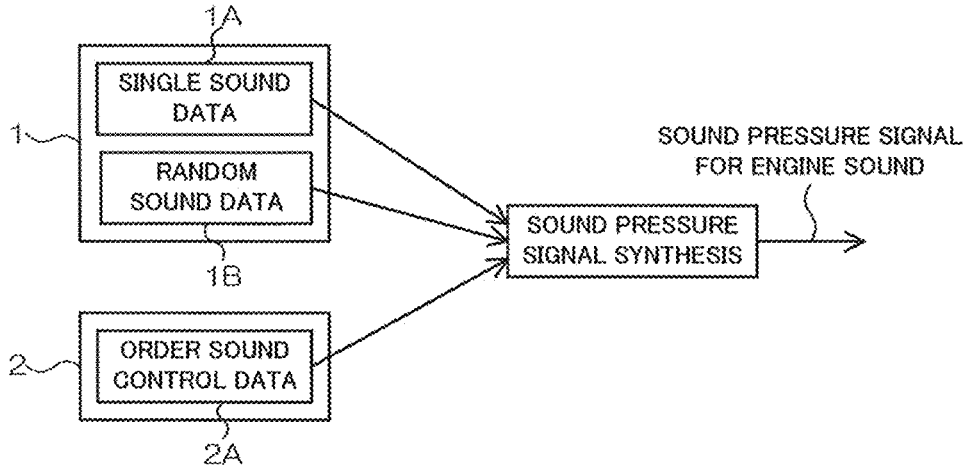
Figure 2A:
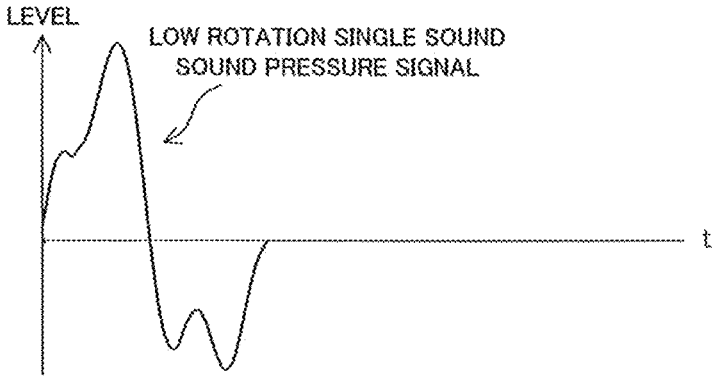
FIG. 2 is a figure illustrating waveforms of single sound sound pressure signals by rotation speed according to the first embodiment, in which FIG. 2(*a*) is a figure illustrating a waveform of a low rotation single sound sound pressure signal according to the first embodiment, and in which FIG. 2(*b*) is a figure illustrating a waveform of a high rotation single sound sound pressure signal according to the first embodiment.
Figure 2B:
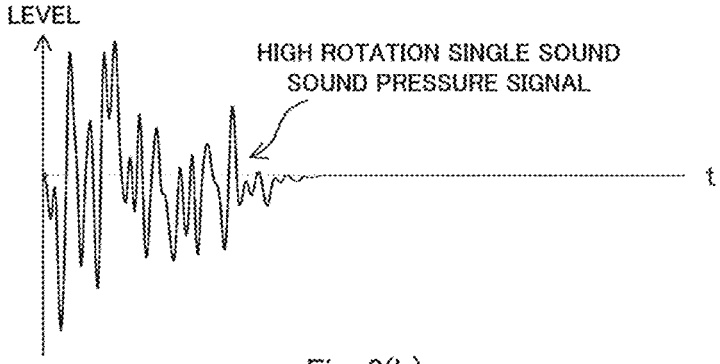
Figure 3:
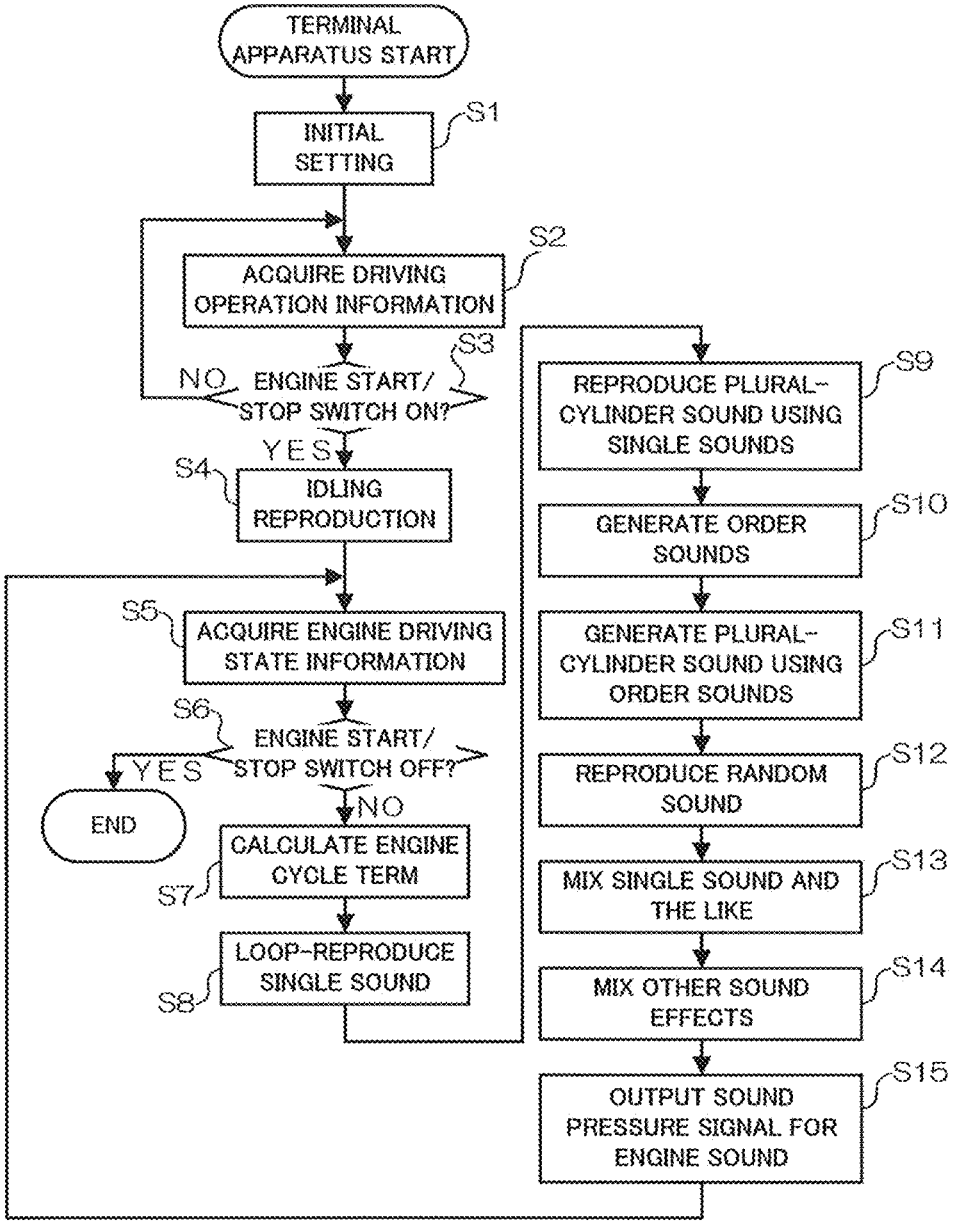
FIG. 3 is a flowchart illustrating sound pressure signal output processing according to the first embodiment.
Figure 4A:
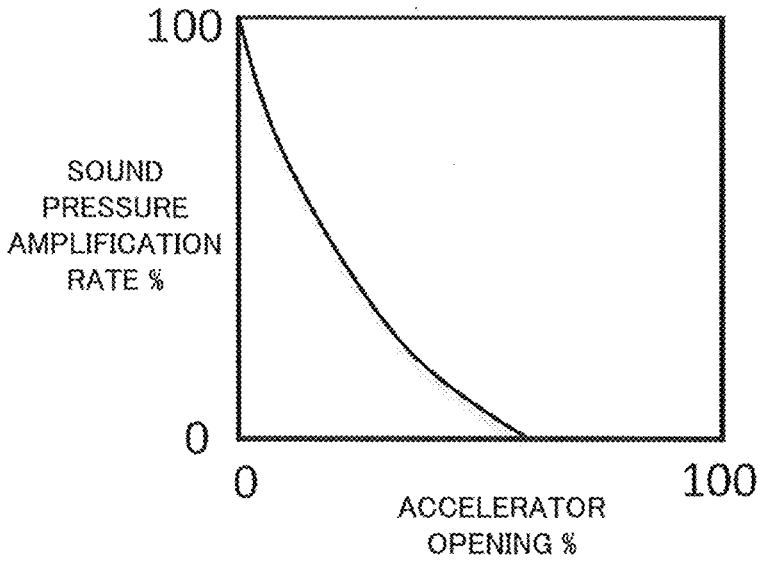
FIG. 4 is a graph illustrating idling reproduction processing in the sound pressure signal output processing according to the first embodiment, in which FIG. 4(*a*) is a graph illustrating the relationship between accelerator opening and sound pressure amplification rate in the idling reproduction processing, and in which FIG. 4(*b*) is a graph illustrating the relationship between rotation speed and the sound pressure amplification rate in the idling reproduction processing.
Figure 4B:
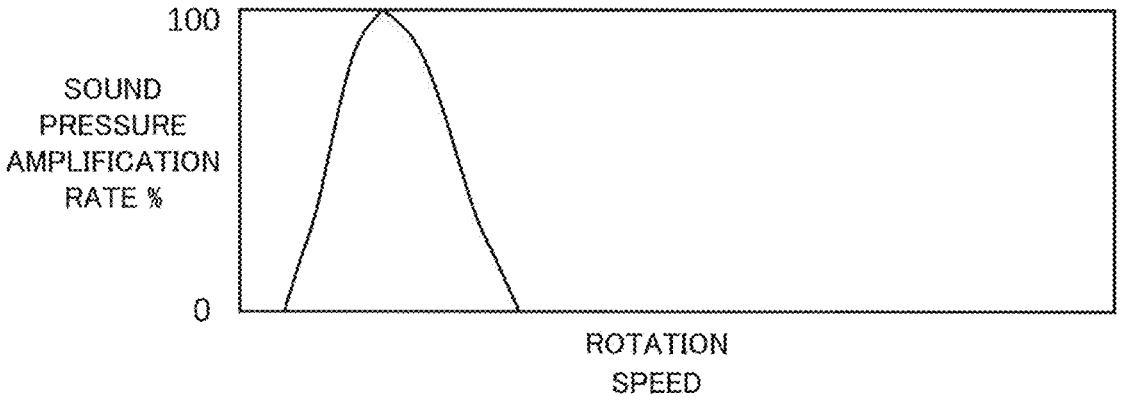
Figure 5A:
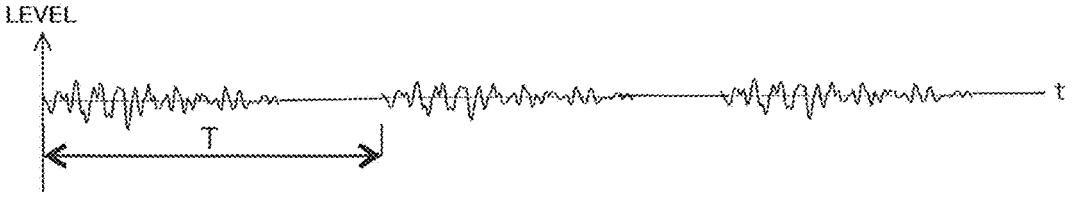
FIG. 5 is a figure illustrating single sound loop reproduction processing in the sound pressure signal output processing according to the first embodiment, in which FIG. 5(*a*) is a figure illustrating a waveform in the single sound loop reproduction processing, in which FIG. 5(*b*) is figure (i) illustrating the relationship between the accelerator opening and the sound pressure amplification rate in the single sound loop reproduction processing, in which FIG. 5(*c*) is figure (ii) illustrating the relationship between the accelerator opening and the sound pressure amplification rate in the single sound loop reproduction processing, in which FIG. 5(*d*) is figure (i) illustrating the relationship between the rotation speed of a single sound and the sound pressure amplification rate in the single sound loop reproduction processing, and in which FIG. 5(*e*) is figure (ii) illustrating the relationship between the rotation speed of a single sound and the sound pressure amplification rate in the single sound loop reproduction processing.
Figure 5B:
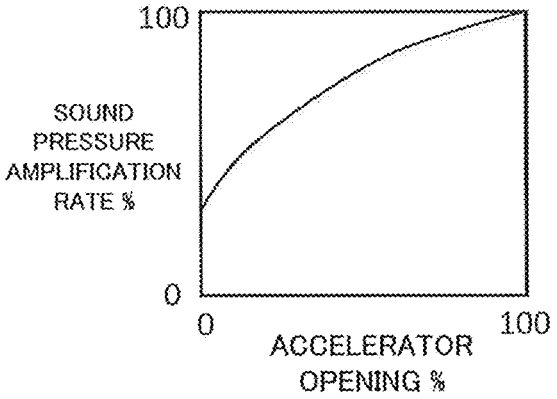
Figure 5C:
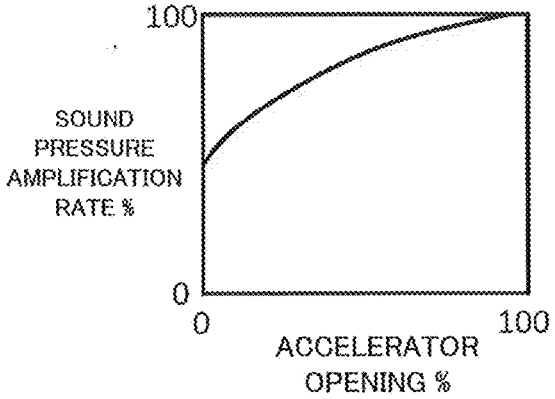
Figure 5D:
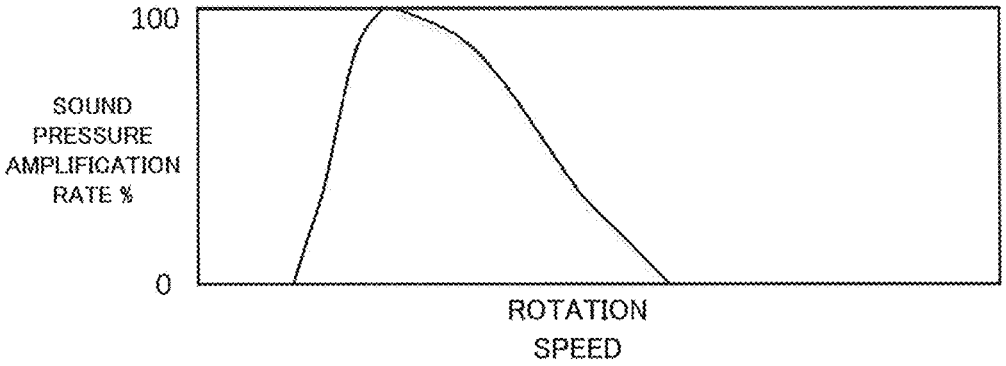
Figure 5E:
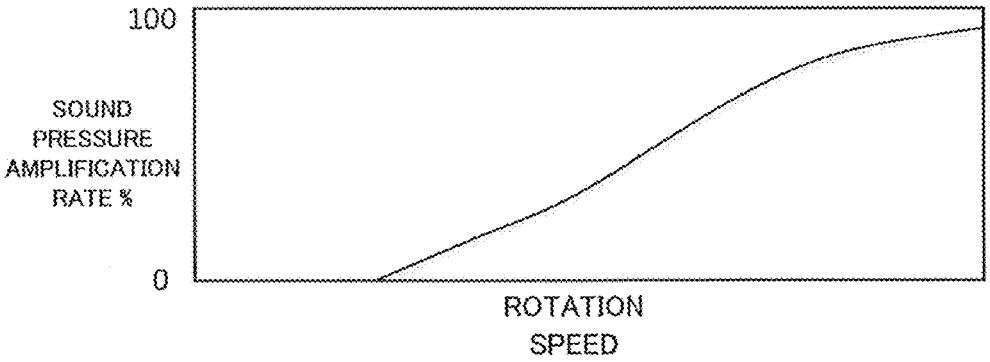
Figure 6:
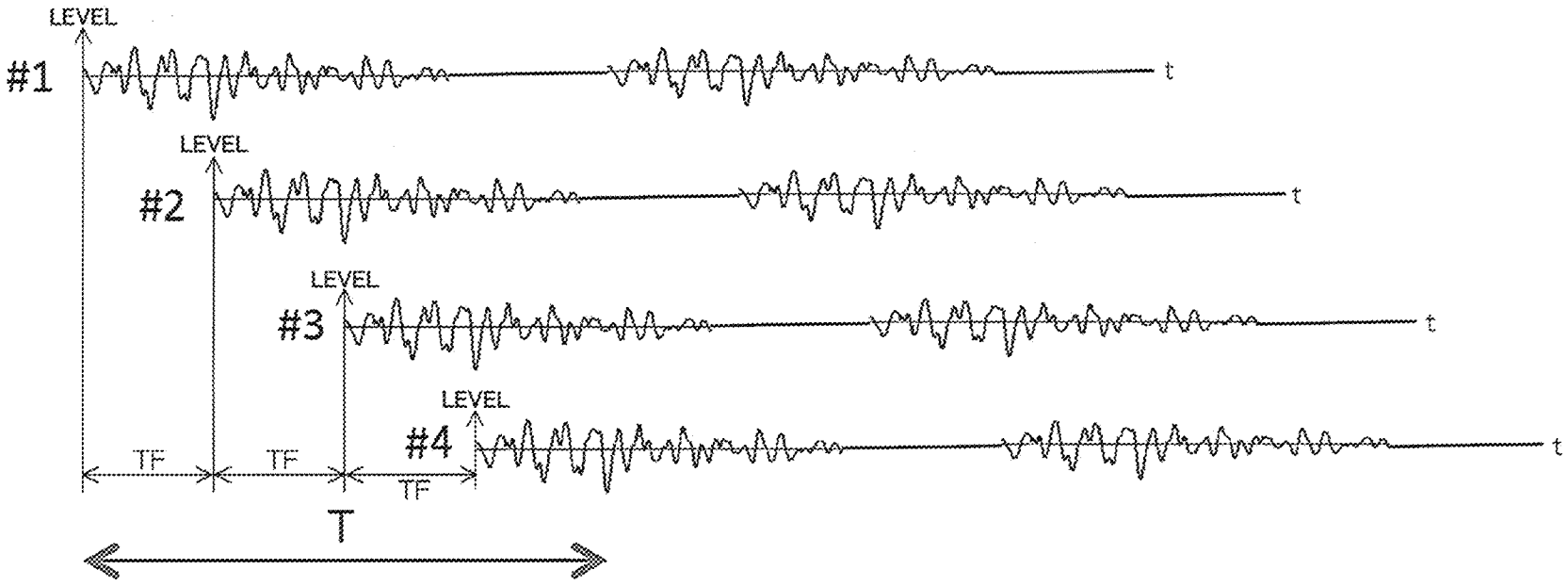
FIG. 6 is a figure illustrating waveforms of plural-cylinder-sound reproduction processing with use of single sounds in the sound pressure signal output processing according to the first embodiment.
Figure 7A:
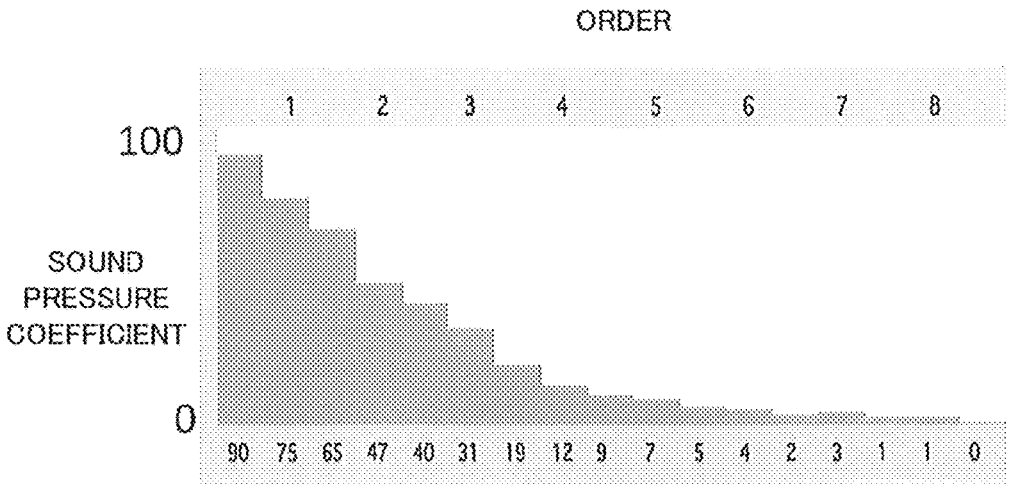
FIG. 7 is figure (I) illustrating order sound waveform generation processing in the sound pressure signal output processing according to the first embodiment, in which FIG. 7(*a*) is a figure illustrating the relationship between an order and a sound pressure coefficient in the order sound waveform generation processing, and in which FIG. 7(*b*) is a figure illustrating waveforms in the order sound waveform generation processing.
Figure 7B:
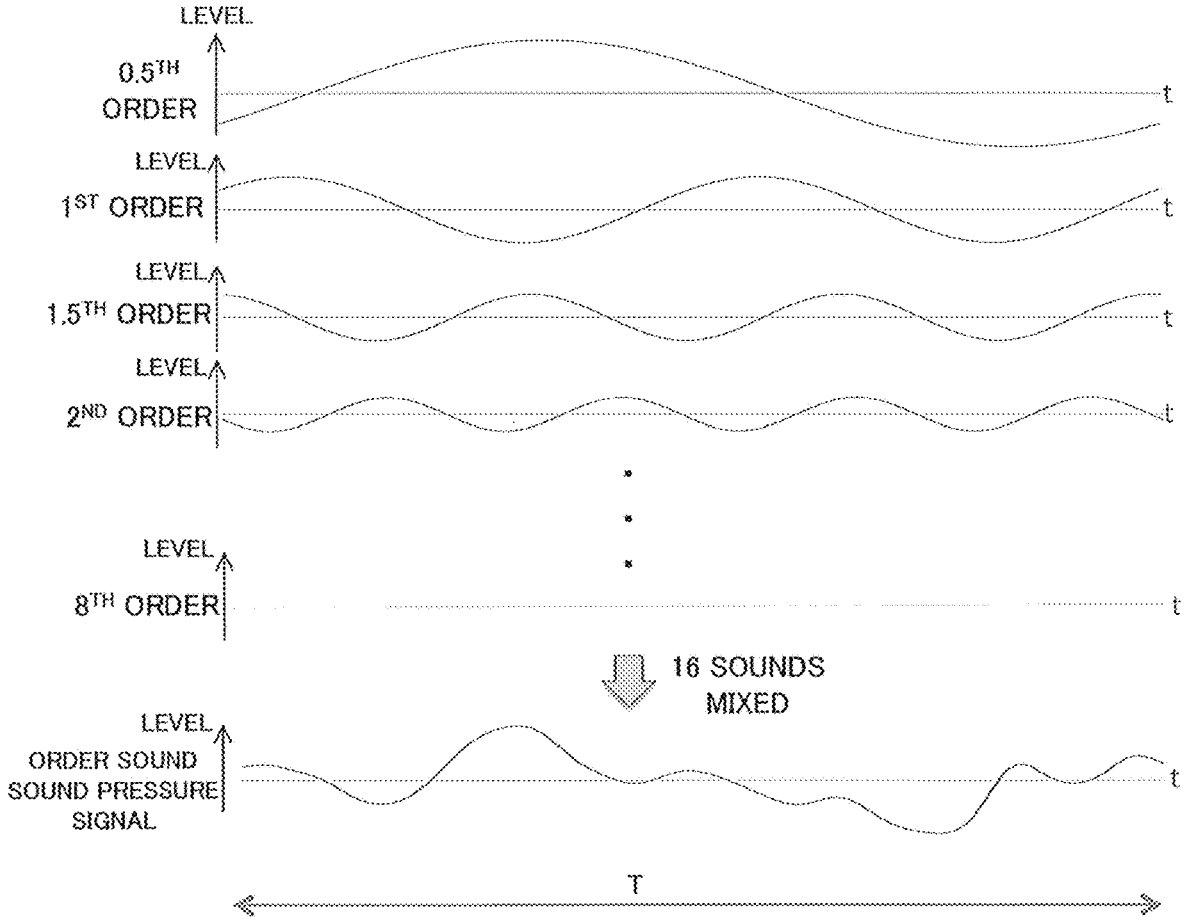
Figure 8A:
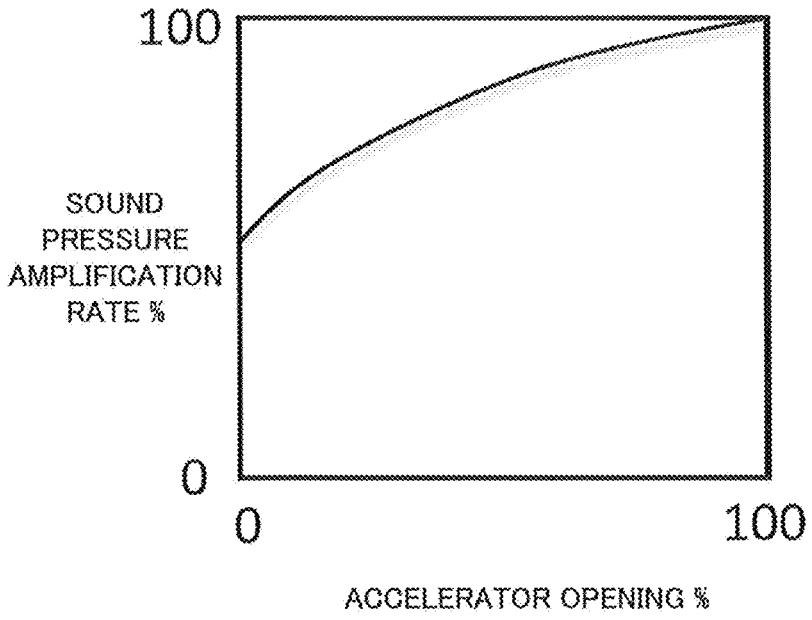
FIG. 8 is figure (II) illustrating order sound waveform generation processing in the sound pressure signal output processing according to the first embodiment, in which FIG. 8(*a*) is a graph illustrating the relationship between the accelerator opening and the sound pressure amplification rate in the order sound waveform generation processing, and in which FIG. 8(*b*) is a graph illustrating the relationship between the rotation speed and the sound pressure amplification rate in the order sound waveform generation processing.
Figure 8B:
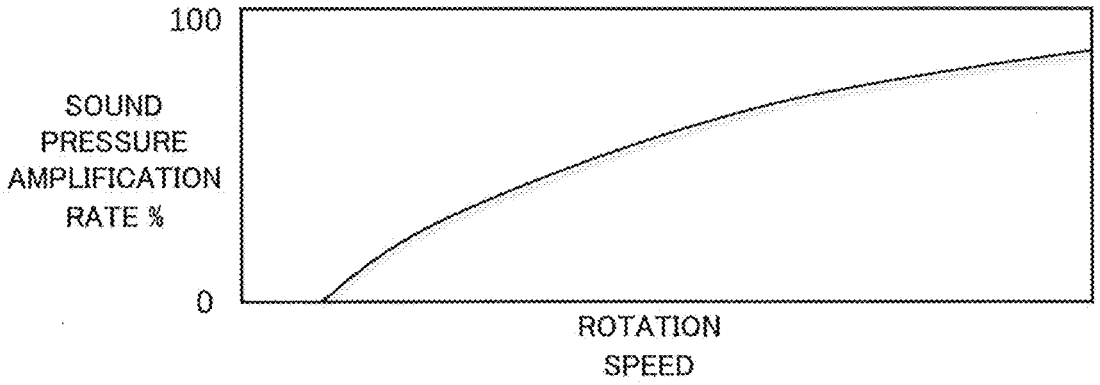
Figure 9:
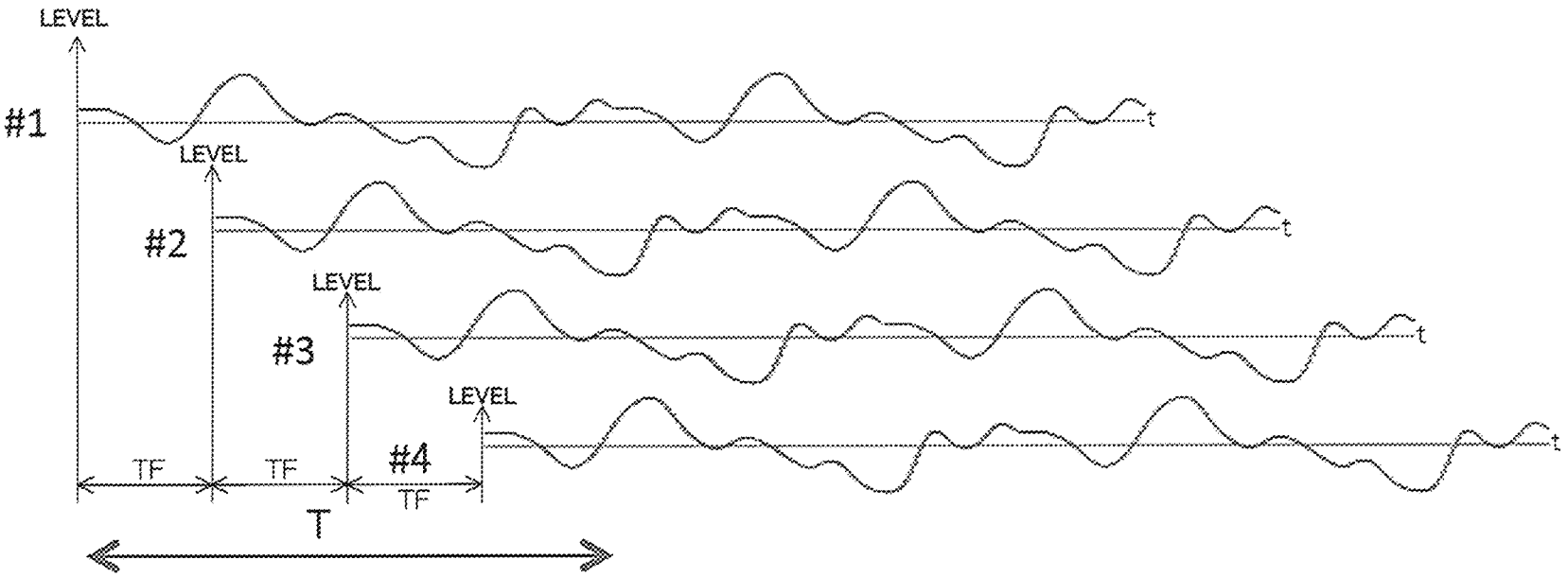
FIG. 9 is a figure illustrating waveforms of plural-cylinder-sound generation processing with use of order sounds in the sound pressure signal output processing according to the first embodiment.
Figure 10A:
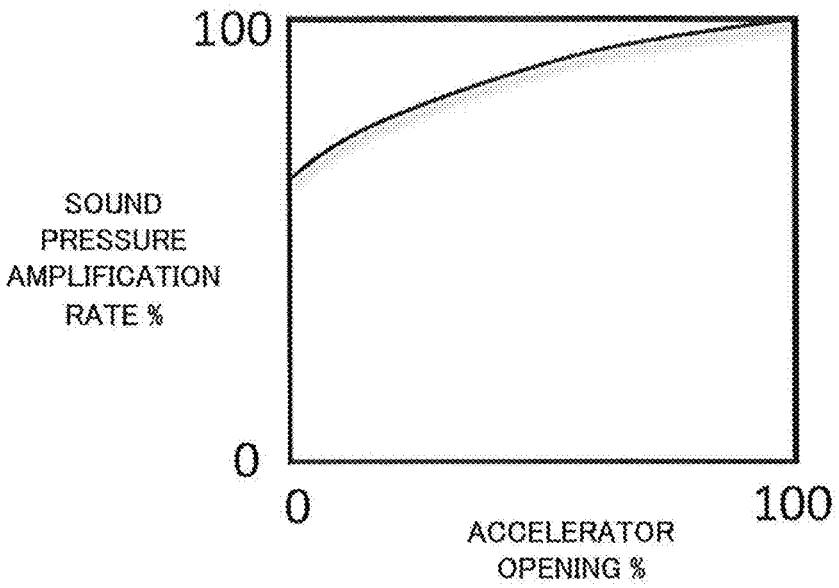
FIG. 10 is a graph illustrating random sound reproduction processing in the sound pressure signal output processing according to the first embodiment, in which FIG. 10(*a*) is a graph illustrating the relationship between the accelerator opening and the sound pressure amplification rate in the random sound reproduction processing, and in which FIG. 10(*b*) is a graph illustrating the relationship between the rotation speed and the sound pressure amplification rate in the random sound reproduction processing.
Figure 10B:
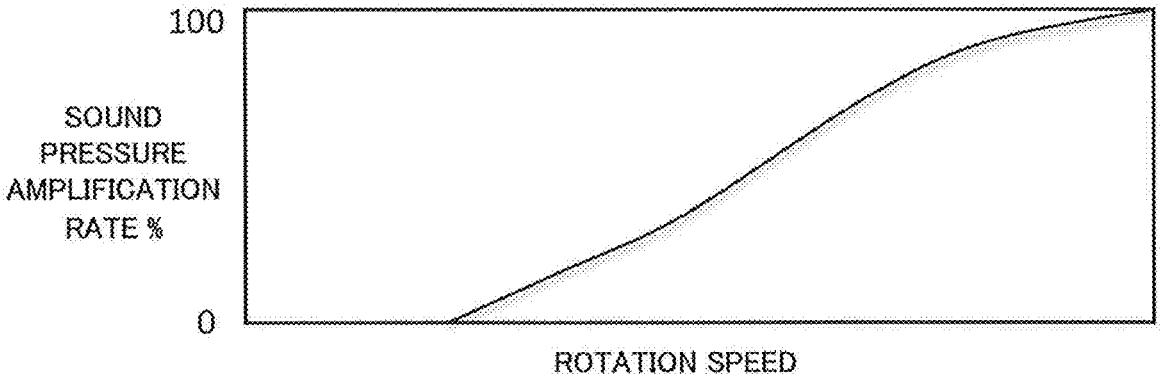
Figure 11:
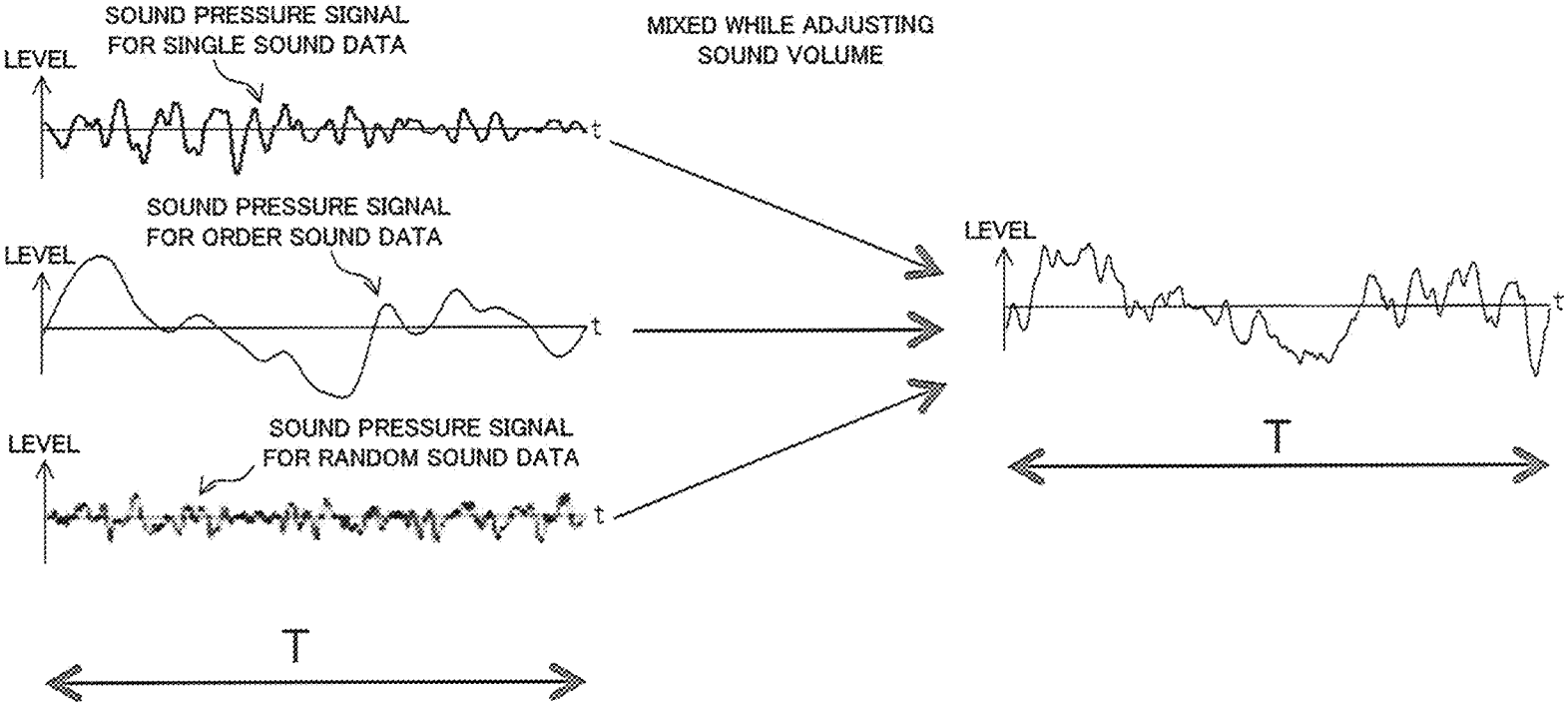
FIG. 11 is a figure illustrating waveforms of single sound and the like synthesis processing in the sound pressure signal output processing according to the first embodiment.

First, a first embodiment of the present invention will be described with reference to FIGS. 1 to 11. Note that FIG. 1 is a block diagram and the like illustrating a schematic configuration of a sound pressure signal output apparatus according to the first embodiment, that FIG. 2 is a figure illustrating waveforms of single sound sound pressure signals by rotation speed according to the first embodiment, that FIG. 3 is a flowchart illustrating sound pressure signal output processing according to the first embodiment, and that FIG. 4 is a graph illustrating idling reproduction processing in the sound pressure signal output processing. Also, FIG. 5 is a figure illustrating single sound loop reproduction processing in the sound pressure signal output processing, FIG. 6 is a figure illustrating waveforms of plural-cylinder-sound reproduction processing with use of single sounds in the sound pressure signal output processing, and FIGS. 7 and 8 are figures illustrating order sound waveform generation processing in the sound pressure signal output processing. Further, FIG. 9 is a figure illustrating waveforms of plural-cylinder-sound generation processing with use of order sounds in the sound pressure signal output processing, FIG. 10 is a graph illustrating random sound reproduction processing in the sound pressure signal output processing, and FIG. 11 is a figure illustrating waveforms of single sound and the like synthesis processing in the sound pressure signal output processing.

As illustrated in FIG. 1(*a*), a sound pressure signal output apparatus S according to the first embodiment includes a database DB recorded in a non-volatile recording medium such as a hard disc drive (HDD) and a solid state drive (SSD) and a processing apparatus 10 fulfilled by a personal computer, a so-called smartphone, or the like. Also, the processing apparatus 10 comprises a processing unit 11 including a CPU, a read-only memory (ROM), a random-access memory (RAM), and the like, an interface 12, an operation unit 13 such as a touch panel, a keyboard, and a mouse, a display unit 14 such as a liquid crystal display, and a loudspeaker 15. The processing unit 11 further comprises a plural-cylinder-sound generation unit 110 and a synthesis unit 111. Also, the plural-cylinder-sound generation unit 110, the synthesis unit 111, of the aforementioned processing unit 11, the interface 12, the operation unit 13, the display unit 14, and the loudspeaker 15 are connected to enable transmission and reception of data or information via a bus 16. Here, the functions of the aforementioned plural-cylinder-sound generation unit 110 and the aforementioned synthesis unit 111 may be fulfilled by a hardware logic circuit such as a CPU constituting the processing unit 11 or may be fulfilled by software as the processing unit 11 reads out and executes a program comparable to below-mentioned sound pressure signal output processing according to the first embodiment. Further, the aforementioned interface 12 is comparable to an example of "a first acquisition means", an example of "a second acquisition means", and an example of "a third acquisition means" according to the present invention, respectively, and the aforementioned plural-cylinder-sound generation unit 110 and the synthesis unit 111 are comparable to an example of "a synthesis means" according to the present invention.

In the above configuration, the database DB has recorded therein sound waveform data 1 according to the first embodiment and sound control data 2 according to the first embodiment in a non-volatile manner.

Here, an overview (principle) of sound pressure signal output processing according to the first embodiment executed in the sound pressure signal output apparatus S according to the first embodiment will be described with reference to FIG. 1(*b*).

As illustrated in FIG. 1(*b*), the sound waveform data 1 recorded in the database DB includes single sound data 1A and random sound data 1B. Also, the sound control data 2 recorded in the database DB includes order sound control data 2A. Also, in the sound pressure signal output processing according to the first embodiment, a sound pressure signal for a corresponding engine sound is synthesized and output with use of a sound pressure signal for the single sound data 1A, a sound pressure signal for order sound data synthesized using the order sound control data 2A, and a sound pressure signal for the random sound data 1B. At this time, a sound pressure signal for below-mentioned additional sound data may be used as well.

Here, the aforementioned single sound data 1A is sound data comparable to a sound generated from one cylinder of the aforementioned engine during one combustion cycle in the cylinder (hereinbelow, the sound generated from the cylinder during one combustion cycle is referred to as "the single sound"). Meanwhile, in the sound pressure signal output processing according to the first embodiment, a sound pressure signal for an engine sound according to the first embodiment is synthesized and output with use of a sound pressure signal for low rotation single sound data, which is sound data comparable to a single sound when the engine is revolving at a predetermined low rotation region (hereinbelow referred to as "a low rotation single sound") and a sound pressure signal for high rotation single sound data, which is sound data comparable to a single sound when the engine is revolving at a predetermined high rotation region (hereinbelow referred to as "a high rotation single sound"), as described below. In this case, an example of a waveform of a sound pressure signal for the low rotation single sound data (low rotation single sound sound waveform signal) is illustrated in FIG. 2(*a*), and an example of a waveform of a sound pressure signal for the high rotation single sound data (high rotation single sound sound waveform signal) is illustrated in FIG. 2(*b*), respectively. In the examples illustrated in FIGS. 2(*a*) and 2(*b*), the length of the sound pressure signal is 50 milliseconds, for example.

Also, the aforementioned order sound data is sound data comparable to a sound component, out of the aforementioned engine sound (or a sound which a vehicle using the aforementioned engine as a power source generates, the same applies hereinbelow), the frequency (or the frequency spectrum, the same applies hereinbelow) of which changes in accordance with the rotation speed and having a so-called overtone structure obtained by synthesizing a preset pure tone (a sound having a sinusoidal waveform) and an overtone thereof based on the order sound control data 2A. Meanwhile, in the sound pressure signal output processing according to the first embodiment, a sound pressure signal for an engine sound is synthesized and output with use of acceleration time order sound data, which is sound data comparable to an order sound when the vehicle is accelerating (hereinbelow referred to as "an acceleration time order sound"), and deceleration time order sound data, which is sound data comparable to an order sound when the vehicle is decelerating (hereinbelow referred to as "a deceleration time order sound"), as described below.

Further, the aforementioned random sound data 1B is sound data comparable to a sound component, out of the aforementioned engine sound, the frequency of which does not substantially change regardless of the rotation speed (that is, a sound component corresponding to at least either a material or a shape of a structure (a part or the like) constituting the aforementioned engine) and is sound data which differs depending on the vehicle type or the engine type (model number).

Still further, the aforementioned additional sound data includes idling sound data comparable to an idling sound corresponding to the aforementioned engine, starter sound data comparable to a starter sound corresponding to the aforementioned engine, gear sound data comparable to a gear sound corresponding to the aforementioned engine, gear shift sound data comparable to a gear shift sound corresponding to the aforementioned engine, rev limiter sound data comparable to a rev limiter sound corresponding to the aforementioned engine, afterfire sound data comparable to an afterfire sound corresponding to the engine, and the like, for example.

Also, the sound waveform data 1 recorded in the database DB includes the aforementioned single sound data 1A including the aforementioned low rotation single sound data and the aforementioned high rotation single sound data, the aforementioned random sound data 1B, the aforementioned starter sound data, and the aforementioned idling sound data, and these are recorded as sound data required for the sound pressure signal output processing according to the first embodiment. Also, in addition to the aforementioned required sound data, the aforementioned gear shift sound data, the aforementioned gear sound data, and the like may be included and recorded in accordance with usage of synthesis of a sound pressure signal for an engine sound, a vehicle type, necessity for a sound effect, or the like.

Meanwhile, the aforementioned sound waveform data 1 is, for example, sound data uniquely synthesized with use of a computer based on data obtained by recording a traveling sound or the like of an actual vehicle and recorded in the database DB in advance per vehicle type or engine type, for example.

On the other hand, the sound control data 2 recorded in the database DB includes and has recorded therein not only the aforementioned order sound control data 2A including accelerator opening and sound pressure amplification rate characteristic control data and rotation speed and sound pressure amplification rate characteristic control data for a sound pressure signal for the aforementioned acceleration time order sound data, accelerator opening and sound pressure amplification rate characteristic control data and rotation speed and sound pressure amplification rate characteristic control data for a sound pressure signal for the aforementioned deceleration time order sound data, acceleration time order sound pressure coefficient data indicating a sound pressure coefficient of the aforementioned acceleration time order sound, and deceleration time order sound pressure coefficient data indicating a sound pressure coefficient of the aforementioned deceleration time order sound but also accelerator opening and sound pressure amplification rate characteristic control data and rotation speed and sound pressure amplification rate characteristic control data for a sound pressure signal for the aforementioned low rotation single sound data, accelerator opening and sound pressure amplification rate characteristic control data and rotation speed and sound pressure amplification rate characteristic control data for a sound pressure signal for the aforementioned high rotation single sound data, accelerator opening and sound pressure amplification rate characteristic control data and rotation speed and sound pressure amplification rate characteristic control data for a sound pressure signal for the aforementioned random sound data, accelerator opening and sound pressure amplification rate characteristic control data and rotation speed and sound pressure amplification rate characteristic control data for a sound pressure signal for the aforementioned idling sound data, cylinder number data indicating the number of cylinders of the aforementioned engine, explosion interval data indicating an explosion interval among the cylinders of the aforementioned engine, and cylinder sound pressure coefficient data indicating a sound pressure coefficient per cylinder. The sound control data 2 also includes and has recorded therein respective sound volume coefficient data for the aforementioned low rotation single sound, the aforementioned high rotation single sound, the aforementioned acceleration time order sound, the aforementioned deceleration time order sound, the aforementioned random sound, the aforementioned starter sound, and the aforementioned idling sound. Meanwhile, the sound control data 2 may include and have recorded therein respective sound volume coefficient data for the aforementioned gear shift sound data, the aforementioned gear sound data, and the like in accordance with the aforementioned usage, the vehicle type, the necessity for a sound effect, or the like.

Meanwhile, as for the aforementioned sound control data 2, the sound control data 2 corresponding to the vehicle type or the engine type, for example, is recorded in the database DB in advance.

On the other hand, data indicating start/stop of the engine targeted for the sound pressure signal output according to the first embodiment and respective data indicating accelerator opening and rotation speed in traveling of the vehicle are input as vehicle data C from an outside via the interface 12 to the processing apparatus 10 in real time. Thus, the plural-cylinder-sound generation unit 110 of the processing unit 11 reads out the aforementioned sound waveform data 1 and the aforementioned sound control data 2 corresponding to the vehicle type, the engine type, or the like via the interface 12 from the database DB and generates a sound pressure signal or the like of sound per cylinder in the sound pressure signal output processing according to the first embodiment. The synthesis unit 111 then synthesizes the sound pressure signal or the like per cylinder generated by the plural-cylinder-sound generation unit 110 into a sound pressure signal for the engine sound according to the first embodiment. At this time, an operation or the like required for the sound pressure signal output processing according to the first embodiment is executed in the operation unit 13, and the operation unit 13 thus generates an operation signal corresponding to the operation or the like and outputs the operation signal to the processing unit 11. The processing unit 11 then executes the sound pressure signal output processing according to the first embodiment to correspond to the operation signal. Meanwhile, information required in the sound pressure signal output processing is provided to a user via the display unit 14. Also, the engine sound comparable to the sound pressure signal synthesized and output in the sound pressure signal output processing is emitted via the loudspeaker 15 as needed. Further, the synthesized sound pressure signal for the engine sound (or the sound data comparable to the sound pressure signal) is associated with data indicating specifications that the engine sound data corresponds to, such as the aforementioned vehicle type and the engine type, and is recorded in the aforementioned non-volatile recording medium having recorded therein the database DB, for example.

Next, the sound pressure signal output processing according to the first embodiment will specifically be described with reference to FIGS. 3 to 11. Note that, in the following description, processing for synthesizing engine sound data for a four-cylinder engine will be illustrated and described.

As illustrated in the flowchart corresponding to FIG. 3, in the sound pressure signal output processing according to the first embodiment, when the sound pressure signal output processing is started by a start operation by means of the operation unit 13, for example, the processing unit 11 first performs initial setting (step S1). Specifically, as the initial setting in step S1, the processing unit 11 retrieves the aforementioned sound waveform data 1 and the aforementioned sound control data 2 recorded in the database DB via the interface 12. At this time, the processing unit 11 retrieves the sound waveform data 1 and the sound control data 2 corresponding to the vehicle type, the engine type, or the like selected by means of a selection operation in the operation unit 13. In addition, the processing unit 11 initializes the accelerator opening, the rotation speed, and the traveling speed (of the vehicle) as parameters in the sound pressure signal output processing according to the first embodiment.

Subsequently, the processing unit 11 acquires driving operation information of the vehicle the sound pressure signal for the engine sound of which is to be synthesized and output via the interface 12 as the vehicle data C (step S2). At this time, the aforementioned driving operation information generally includes operation information for an engine start/stop switch, information indicating the aforementioned accelerator opening, information indicating the aforementioned rotation speed, and the like. However, since the engine still stops at the stage of step S2, what is acquired in step S2 is the operation information for the engine start/stop switch. The processing unit 11 then determines whether or not the operation information indicating that the engine start/stop switch is turned on (that is, that the engine is started) is acquired in step S2 (step S3). In the determination in step S3, in a case in which the operation information indicating that the engine start/stop switch is turned on is not acquired (step S3: NO), the processing unit 11 returns to step S2 and waits for acquisition of the operation information indicating the on state. Conversely, in step S3, in a case in which the operation information indicating that the engine start/stop switch is turned on is acquired (step S3: YES), the plural-cylinder-sound generation unit 110 then executes idling reproduction processing (step S4). In the idling reproduction processing in step S4, in response to the operation information indicating that the aforementioned engine start/stop switch is turned on, the plural-cylinder-sound generation unit 110 reproduces the aforementioned starter sound data to output a corresponding sound pressure signal and thereafter loop-reproduces the aforementioned idling sound data to output a corresponding sound pressure signal, to simulate the idling state. Here, the sound pressure values at the time of reproduction of the aforementioned sound pressure signal for the starter sound data and the sound pressure signal for the aforementioned idling sound data are controlled based on the respective sound volume coefficient data for the starter sound and the idling sound retrieved from the database DB in step S1. In addition, the sound pressure amplification rate for the sound pressure signal for the idling sound data is controlled based on the respective data indicating the accelerator opening and the rotation speed input as the vehicle data C with use of accelerator opening and sound pressure amplification rate characteristic control data illustrated in FIG. 4(*a*) and rotation speed and sound pressure amplification rate characteristic control data illustrated in FIG. 4(*b*).

Subsequently, during the idling reproduction processing (step S4), the processing unit 11 acquires in a cyclic manner as the vehicle data C information indicating the driving state of the engine (for example, the rotation speed and the gear shift position) and the driving operation of the vehicle (for example, the accelerator opening, the traveling speed, and the state of the engine start/stop switch) (step S5). The cycle for acquiring the respective information in step S5 is preset in accordance with the specifications and the like of the processing unit 11, and specifically, the cycle is preferably about tens of milliseconds. The processing unit 11 then determines whether or not the engine start/stop switch is turned off (that is, the engine is stopped) based on the respective information acquired in step S5 (step S6). In a case in which it is determined in the determination in step S6 that the engine start/stop switch is turned off (step S6: YES), the processing unit 11 ends the sound pressure signal output processing according to the first embodiment. Conversely, in a case in which it is not determined in the determination in step S6 that the engine start/stop switch is turned off (step S6: NO), the processing unit 11 subsequently calculates a term T (unit: second) of an engine operation cycle for the engine sound to be synthesized (step 37). Note that, in the following description, the term of the operation cycle is referred to simply as "the engine cycle term". Here, in a most common four-stroke engine, a period in which a crankshaft is rotated by 720 degrees is equal to the engine cycle term T and changes depending on the rotation speed. Therefore, when the rotation speed (unit: rpm (round per minute)) is N, the engine cycle term T is calculated by Equation (1) below.

$$T=120/N \tag{1}$$

Meanwhile, it is to be considered that Equation (1) above differs in cases of a two-stroke engine and a rotary engine.

Subsequently, the plural-cylinder-sound generation unit 110 respectively loop-reproduces the sound pressure signal for the low rotation single sound data and the sound pressure signal for the high rotation single sound data for one cylinder to match the rotation speed (step S8). In step S8, as illustrated in FIG. 5(*a*), the plural-cylinder-sound generation unit 110 loop-reproduces the sound pressure signal for the low rotation single sound data and the sound pressure signal for the high rotation single sound data in the engine cycle term T calculated in step S7. At this time, the plural-cylinder-sound generation unit 110 changes the reproduction sound pressure of the sound pressure signal for each single sound data at random in a preset range per engine cycle term T. Also, an example of the relationship between the accelerator opening and the sound pressure amplification rate at the time of reproduction for the sound pressure signal for the low rotation single sound data is illustrated in FIG. 5(*b*), and an example thereof for the sound pressure signal for the high rotation single sound data is illustrated in FIG. 5(*c*). Further, an example of the relationship between the rotation speed and the sound pressure amplification rate at the time of reproduction for the sound pressure signal for the low rotation single sound data is illustrated in FIG. 5(*d*), and an example thereof for the sound pressure signal for the high rotation single sound data is illustrated in FIG. 5(*e*). At this time, as illustrated in FIGS. 5(*d*) and 5(*e*), the sound pressure signal for the low rotation single sound data and the sound pressure signal for the high rotation single sound data are reproduced to be cross-faded in relation to the rotation speed.

Subsequently, the plural-cylinder-sound generation unit 110 makes copies of the sound pressure signal for the low rotation single sound data and the sound pressure signal for the high rotation single sound data reproduced in step S8 for the remaining three cylinders and reproduces the copies after providing delay that matches the explosion interval (combustion interval) among the cylinders indicated by the aforementioned explosion interval data (step S9). More specifically, as illustrated in FIG. 6, the plural-cylinder-sound generation unit 110 makes copies of the sound pressure signal for the low rotation single sound data and the sound pressure signal for the high rotation single sound data by providing as long delay as an explosion interval TF per cylinder with reference to the engine cycle term T and reproduces the copies. Meanwhile, in FIG. 6, the order of explosion of the respective cylinders is illustrated by "#". Also, the aforementioned explosion interval TF may be equal or different among the cylinders. Further, as for the sound pressure of each of the sound pressure signals for the low rotation single sound data and the high rotation single sound data, a configuration may be available in which the sound pressure is reproduced after the sound pressure is multiplied by a sound pressure coefficient (in other words, an amplitude magnification) that differs per cylinder.

Subsequently, the plural-cylinder-sound generation unit 110 generates sixteen sound pressure signals for 0.5th-order to 8th-order order sound data, for example, in 0.5-order steps with use of the aforementioned preset sinusoidal waveform and the order sound control data 2A, for example (step S10). At this time, the plural-cylinder-sound generation unit 110 generates each sound pressure signal for each order sound data to have the aforementioned sinusoidal waveform having each single frequency component and corresponding to the vehicle type or the engine type by changing each phase at random. Here, the frequency of the sound pressure signal for each order sound changes depending on the rotation speed, and the change is calculated in Equation (2) below, where "$F_n$" is frequency of a sound pressure signal for an nth-order order sound (unit: Hz), where "$O_d$" is an order (no unit) changing from 0.5 to 8, and where "N" is the aforementioned rotation speed.

$$F_n=O_d\times N/60 \tag{2}$$

On the other hand, the plural-cylinder-sound generation unit 110 reproduces the sound pressure signal for each order sound data while controlling the sound pressure of the sound pressure signal for each order sound based on the aforementioned order sound control data 2A indicating the relationship between the order and the sound pressure coefficient illustrated in FIG. 7(*a*), for example. At this time, in general, the sound pressure of the sound pressure signal is controlled so that the sound pressure may be lower as the order is higher. The plural-cylinder-sound generation unit 110 then mixes the sound pressure signals for the order sounds generated respectively as illustrated in FIG. 7(*b*) to generate a sound pressure signal for order sound data for one engine cycle term T. Thereafter, the plural-cylinder-sound generation unit 110 reproduces the mixed sound pressure signal for the order sound data while controlling the sound pressure of the sound pressure signal based on the respective data indicating the accelerator opening and the rotation speed input as the vehicle data C with use of accelerator opening and sound pressure amplification rate characteristic control data illustrated in FIG. 8(*a*) and rotation speed and sound pressure amplification rate characteristic control data illustrated in FIG. 8(*b*). At this time, the plural-cylinder-sound generation unit 110 may be configured to control the sound pressure of the sound pressure signal for the order sound data in accordance with the accelerator opening, for example, by separately using the aforementioned acceleration time order sound pressure coefficient data and the aforementioned deceleration time order sound pressure coefficient data.

Subsequently, the plural-cylinder-sound generation unit 110 makes copies of the sound pressure signal for the order sound data reproduced in step S10 for the remaining three cylinders and reproduces the copies after providing delay that matches the explosion interval among the cylinders indicated by the aforementioned explosion interval data (step S11). More specifically, as illustrated in FIG. 9, the plural-cylinder-sound generation unit 110 makes copies of the sound pressure signal for the order sound data by providing as long delay as the explosion interval TF per cylinder with reference to the engine cycle term T and reproduces the copies. Meanwhile, in FIG. 9, the order of explosion of the respective cylinders is illustrated by "#" in a similar manner to the case illustrated in FIG. 6. Also, the aforementioned explosion interval TF may be equal or different among the cylinders in a similar manner to the case illustrated in FIG. 6. Further, the sound pressure of the sound pressure signal for the order sound data for each cylinder may be reproduced after the sound pressure is multiplied by a different sound pressure coefficient per cylinder.

Subsequently, the plural-cylinder-sound generation unit 110 executes random sound reproduction processing (step S12). In the random sound reproduction processing in step S12, the plural-cylinder-sound generation unit 110 continuously loop-reproduces the sound pressure signal for the random sound data 1B corresponding to the engine or the vehicle type and comparable to the engine sound synthesized by the sound pressure signal output processing according to the first embodiment. Here, although the pitch (frequency) and the loop term at the time of reproduction of the sound pressure signal for the aforementioned random sound data are not changed regardless of the accelerator opening and the rotation speed, the sound pressure amplification rate therefor is controlled based on the respective data indicating the accelerator opening and the rotation speed input as the vehicle data C with use of accelerator opening and sound pressure amplification rate characteristic control data illustrated in FIG. 10(*a*) and rotation speed and sound pressure amplification rate characteristic control data illustrated in FIG. 10(*b*).

Thereafter, the synthesis unit 111 of the processing unit 11 mixes the sound pressure signals for the low rotation single sound data and the sound pressure signals for the high rotation single sound data for the respective cylinders reproduced in step S9 (refer to FIG. 6), the sound pressure signals for the order sound data for the respective cylinders reproduced in step S11, and the sound pressure signal for the random sound data reproduced in step S12 with reference to the engine cycle term T (step S13). At this time, as illustrated in FIG. 11, the synthesis unit 111 mixes the signals while adjusting the sound volume by multiplying each sound data by the sound volume coefficient indicated by the sound volume coefficient data retrieved in step S1 corresponding to the sound pressure signal of each sound.

Thereafter, in a case in which the aforementioned gear sound, the aforementioned gear shift sound, the aforementioned rev limiter sound, or the aforementioned afterfire sound is added as a sound effect in accordance with usage of the sound pressure signal for the engine sound synthesized in the sound pressure signal output processing according to the first embodiment, the synthesis unit 111 extracts the sound data comparable to these sounds from the sound waveform data 1 and mixes the sound data with the sound pressure signal mixed in step S13 (step S14). At this time, the synthesis unit 111 performs mixture while adjusting the sound pressure of the sound pressure signal for each sound data with use of the corresponding sound volume coefficient data.

Thereafter, the processing unit 11 converts the sound pressure signal generated/mixed in the processing through step S14, serving as the sound pressure signal for the engine sound as a result of the sound pressure signal output processing according to the first embodiment, into an analog signal in a not-illustrated digital/analog (D/A) conversion unit and emits the sound from the loudspeaker 15, for example (step S15). Further, the processing unit 11 associates the sound pressure signal for the engine sound (or the sound data comparable to the sound pressure signal) with data indicating specifications (the aforementioned vehicle type, the engine type, or the like) that the sound pressure signal for the engine sound corresponds to and records the sound pressure signal in the aforementioned non-volatile recording medium having recorded therein the database DB, for example, as needed. The processing unit 11 then returns to step S5 described above and repeats the sequence of processing.

As described above, with the sound pressure signal output processing according to the first embodiment, since the sound pressure signal for the engine sound is synthesized and output with use of the sound pressure signal for the single sound data, the sound pressure signal for the order sound data, and the sound pressure signal for the random sound data, it is possible to synthesize and output the sound pressure signal for the engine sound resembling an actual engine sound at low processing load and in real time while flexibly dealing with a change of engine specifications (for example, the number of cylinders, the explosion interval, whether or not the engine is a rotary engine, and the like).

Also, since the single sound data 1A and the order sound data (order sound control data 2A) for each cylinder of the engine are respectively acquired, the sound pressure signals for the single sound data and the sound pressure signals for the order sound data are delayed to match the explosion interval among the respective cylinders, and the sound pressure signals for the single sound data, the sound pressure signals for the order sound data, and the sound pressure signal for the random sound data are synthesized, it is possible to synthesize and output the sound pressure signal for the engine sound resembling an actual engine sound more.

Further, in a case in which the sound pressure coefficient (amplitude magnification) of at least either the sound pressure signal for the single sound data or the sound pressure signal for the order sound data differs per cylinder, it is possible to synthesize and output the sound pressure signal for the engine sound providing much more realistic sensation.

Still further, in any cases of i) a case in which one sound pressure signal for the single sound data comprises the sound pressure signal for the low rotation single sound data and the sound pressure signal for the high rotation speed single sound data, ii) a case in which the sound pressure signal for the single sound data is synthesized by cross-fading the sound pressure signal for the low rotation single sound data and the sound pressure signal for the high rotation single sound data based on the rotation speed of the engine (refer to FIGS. 5(*d*) and 5(*e*)), or iii) a case in which the sound pressure signal for the acceleration time order sound data and the sound pressure signal for the deceleration time order sound data form one sound pressure signal for the order sound data, it is possible to synthesize and output the sound pressure signal for the engine sound providing more realistic sensation.

Also, since the sound pressure of the sound pressure signal for the single sound data, the sound pressure of the sound pressure signal for the order sound data, and the sound pressure of the sound pressure signal for the random sound data are controlled for the synthesis based on the accelerator opening and the rotation speed, it is possible to synthesize and output the sound pressure signal for the engine sound providing much more realistic sensation.

Further, in a case in which the sound pressure signal for the engine sound is synthesized by additionally using at least any of the idling sound data, the starter sound data, the gear sound data, the gear shift sound data, the rev limiter sound data, or the afterfire sound data, various sound effects are added, and it is possible to synthesize and output the sound pressure signal for the engine sound providing more realistic sensation.

(II) Second Embodiment

Figure 13:
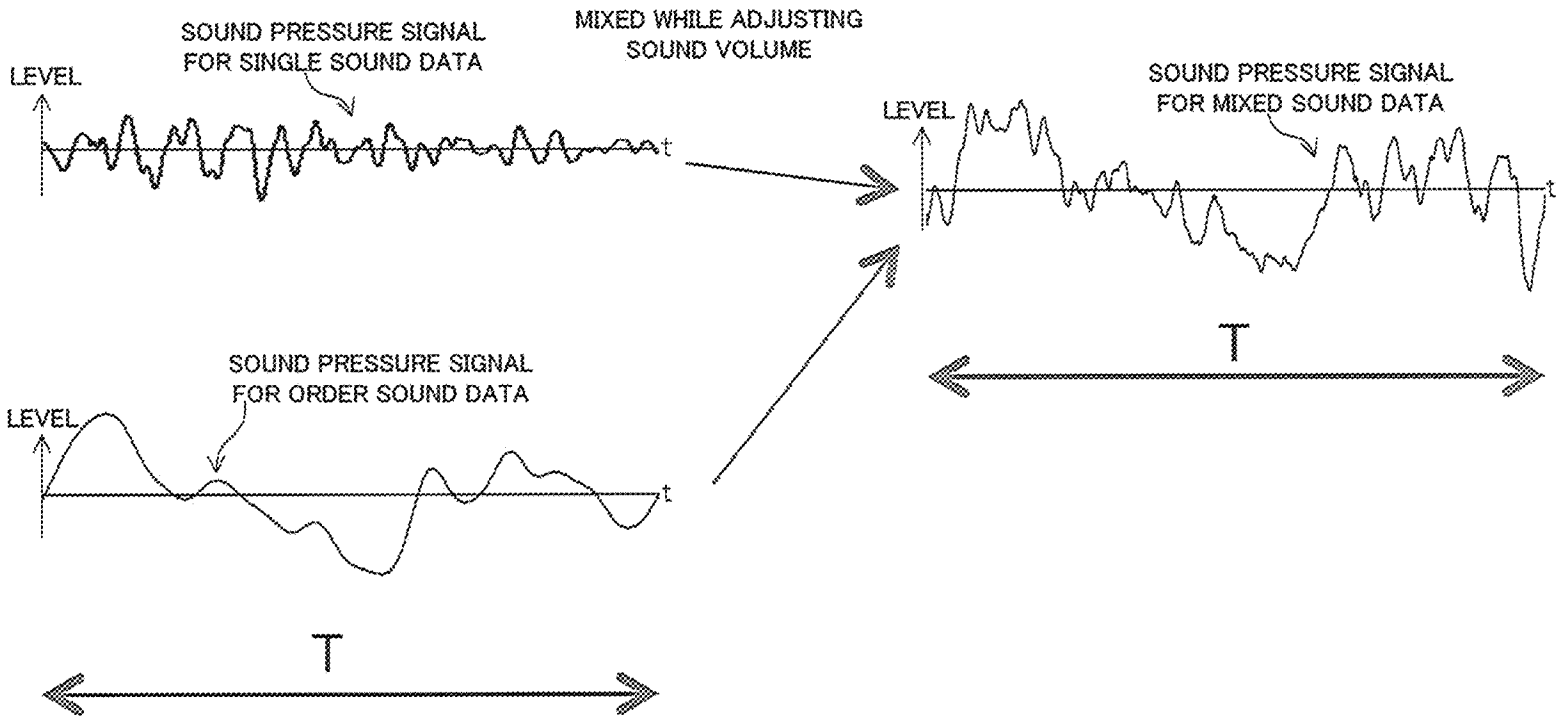
FIG. 13 is a figure illustrating waveforms of single-cylinder-sound generation processing in the sound pressure signal output processing according to the second embodiment.
Figure 14:
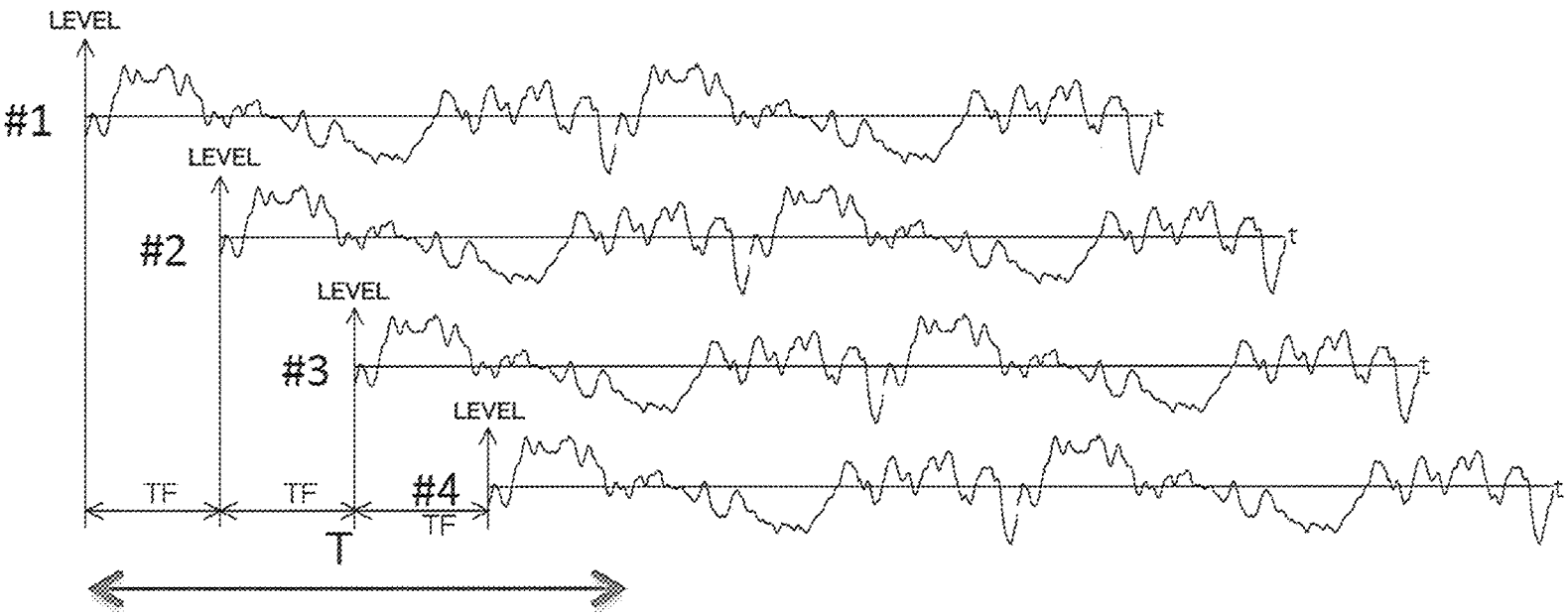
FIG. 14 is a figure illustrating waveforms of plural-cylinder-sound generation processing by means of delay in the sound pressure signal output processing according to the second embodiment.
Figure 15:
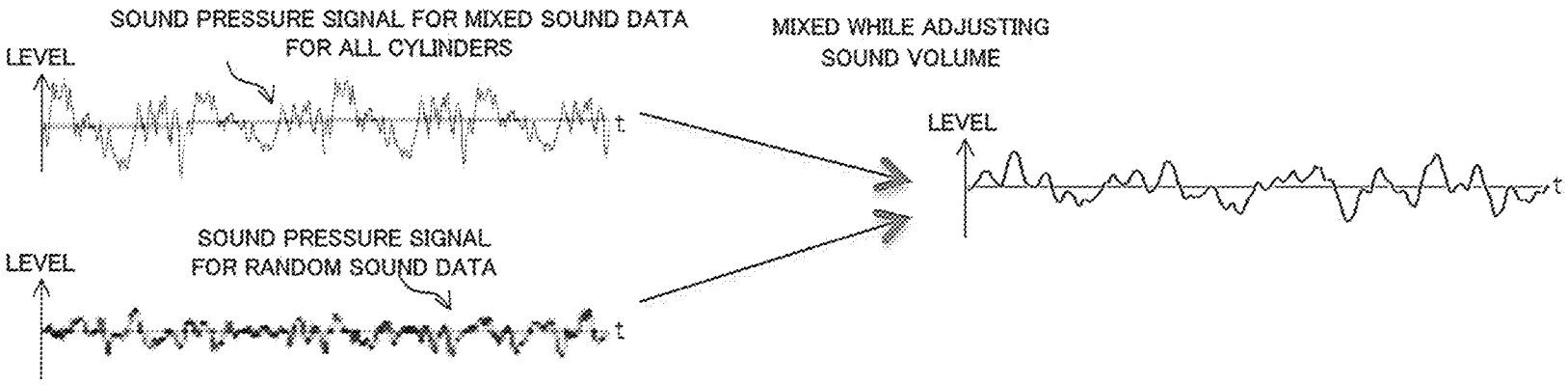
FIG. 15 is a figure illustrating waveforms of synthesis processing for a sound pressure signal for a plural-cylinder sound and a sound pressure signal for a random sound in the sound pressure signal output processing according to the second embodiment.

Next, a second embodiment, which is another embodiment of the present invention, will be described with reference to FIGS. 12 to 15. Meanwhile, FIG. 12 is a flowchart illustrating sound pressure signal output processing according to the second embodiment, FIG. 13 is a figure illustrating waveforms of single-cylinder-sound generation processing in the sound pressure signal output processing, FIG. 14 is a figure illustrating waveforms of plural-cylinder-sound reproduction processing by means of delay in the sound pressure signal output processing, and FIG. 15 is a figure illustrating waveforms of synthesis processing for a sound pressure signal for a plural-cylinder sound and a sound pressure signal for a random sound in the sound pressure signal output processing.

Also, a hardware configuration of a sound pressure signal output apparatus according to the second embodiment described below is basically similar to the sound pressure signal output apparatus S according to the first embodiment. Hence, in the following description of the sound pressure signal output apparatus according to the second embodiment, similar component members to those of the sound pressure signal output apparatus S according to the first embodiment are labeled with the similar reference signs, and detailed description is omitted. Further, in the sound pressure signal output processing according to the second embodiment described below, similar processes to those in the sound pressure signal output processing according to the first embodiment are labeled with the same step numbers to those illustrated in FIG. 3, and detailed description is omitted.

In the aforementioned sound pressure signal output processing according to the first embodiment, as for each of the sound pressure signal for the single sound data and the sound pressure signal for the order sound data, as many sound pressure signals for each of the respective sound data as the number of plural cylinders are generated separately (refer to step S9 and step S11 in FIG. 3), and the sound pressure signals and the sound pressure signal for the random sound data are finally mixed (refer to step S13 in FIG. 3). Conversely, in the sound pressure signal output processing according to the second embodiment described below, for one cylinder, the sound pressure signal for the single sound data and the sound pressure signal for the order sound data are mixed to generate a sound pressure signal for mixed sound data for the cylinder, based on the sound pressure signal for the mixed sound data, as many sound pressure signals for the mixed sound data as the number of cylinders are then generated, and the sound pressure signal for the random sound data is finally mixed.

Figure 12:
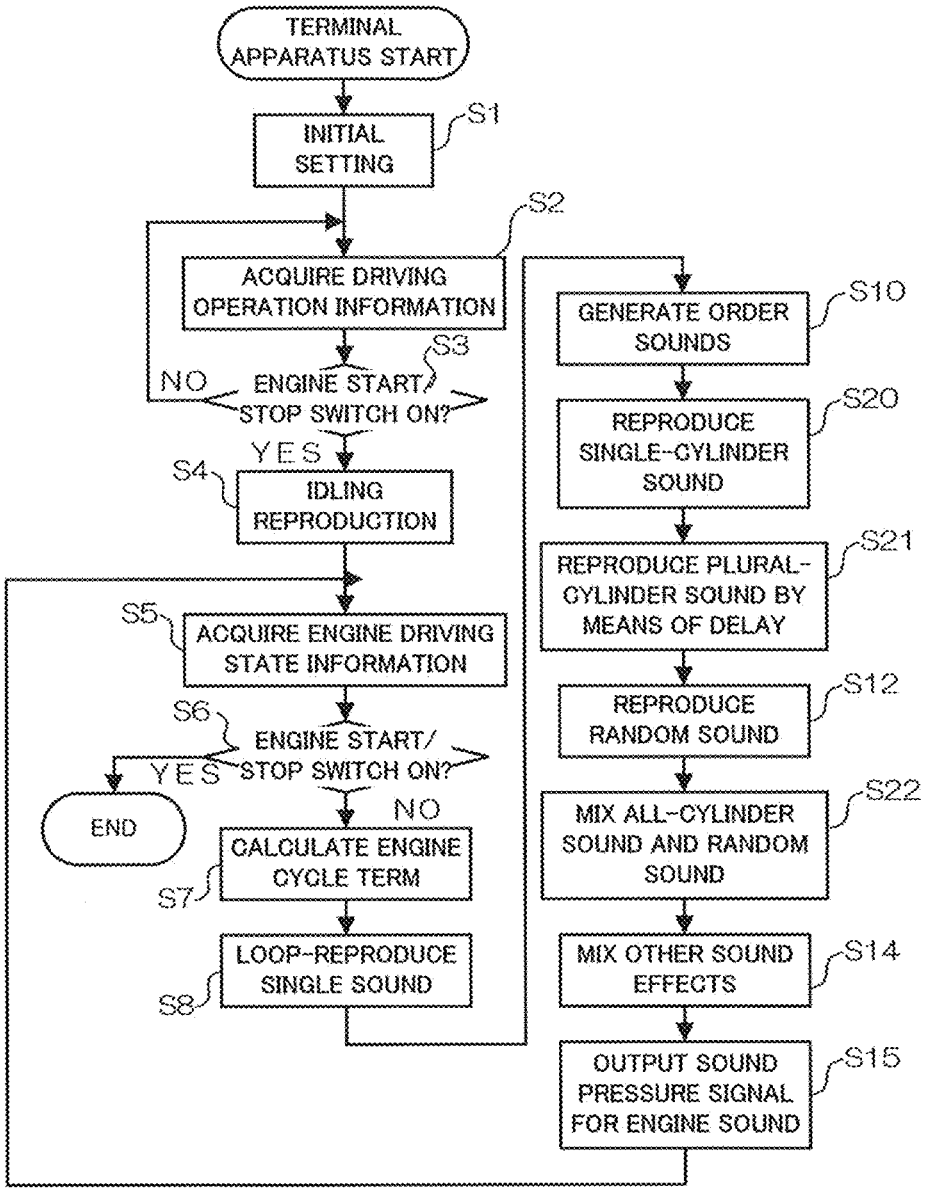
FIG. 12 is a flowchart illustrating sound pressure signal output processing according to a second embodiment.

That is, as illustrated in FIG. 12, in the sound pressure signal output processing according to the second embodiment, step S1 to step S8 and step S10 in the sound pressure signal output processing according to the first embodiment are executed by the plural-cylinder-sound generation unit 110. At this time, step S9 in the sound pressure signal output processing according to the first embodiment is not executed.

Subsequently, the plural-cylinder-sound generation unit 110 mixes the sound pressure signal for the low rotation single sound data and the sound pressure signals for the high rotation single sound data for one cylinder reproduced in step S8 and the sound pressure signal for the order sound data for the cylinder generated in step S10 with reference to the engine cycle term T (step S20). At this time, as illustrated in FIG. 13, the synthesis unit 111 mixes the signals while adjusting the sound volume by multiplying the sound pressure signal for each sound by the sound volume coefficient indicated by the sound volume coefficient data retrieved in step S1 corresponding to the sound pressure signal of each sound to generate a sound pressure signal for mixed sound data.

Subsequently, the plural-cylinder-sound generation unit 110 makes copies of the sound pressure signal for the mixed sound data generated in step S20 for the remaining three cylinders and reproduces the copies after providing delay that matches the explosion interval among the cylinders indicated by the aforementioned explosion interval data (step S21). More specifically, as illustrated in FIG. 14, the plural-cylinder-sound generation unit 110 makes copies of the sound pressure signal for the mixed sound data by providing as long delay as the explosion interval TF per cylinder with reference to the engine cycle term T and reproduces the copies. Meanwhile, in FIG. 14, the order of explosion of the respective cylinders is illustrated by "#". Also, the aforementioned explosion interval TF may be equal or different among the cylinders. Further, the sound pressure of the mixed sound data for each cylinder may be reproduced after the sound pressure is multiplied by a different sound pressure coefficient per cylinder.

Subsequently, the plural-cylinder-sound generation unit 110 executes step S12 in the sound pressure signal output processing according to the first embodiment, and thereafter, the synthesis unit 111 mixes the sound pressure signal for the mixed sound data for all of the cylinders generated in step S20 (refer to FIG. 13) and the sound pressure signal for the random sound data reproduced in step S12 with reference to the engine cycle term T (step S22). At this time, as illustrated in FIG. 15, the synthesis unit 111 mixes the signals while adjusting the sound volume by multiplying the sound pressure signal for each sound data by the sound volume coefficient indicated by the sound volume coefficient data retrieved in step S1 corresponding to each sound.

Thereafter, the synthesis unit 111 executes step S14 and step S15 in the sound pressure signal output processing according to the first embodiment and moves to step S5.

With the sound pressure signal output processing according to the second embodiment described above, a similar effect to that in the sound pressure signal output processing according to the first embodiment can be exerted.

(III) Third Embodiment

Next, a third embodiment, which is still another embodiment of the present invention, will be described.

In the aforementioned first and second embodiments, as for the sound pressure signal for the order sound data, the sound pressure signals reproduced for the respective cylinders are mixed to synthesize and output the sound pressure signal for the order sound data as an entire engine sound. However, instead of this configuration, at the time of synthesizing and outputting a sound pressure signal for a multi-cylinder engine sound, sound pressure signals for order sounds corresponding to the multiple cylinders may be synthesized at once for the multiple cylinders. In this case as well, the sound pressure signals for the order sound data for the respective cylinders, each of which is a sound component having the overtone structure with use of the aforementioned sinusoidal waveform and the overtone thereof, can be synthesized together.

With the sound pressure signal output processing according to the third embodiment described above, a similar effect to those in the sound pressure signal output processing according to the first and second embodiments can be exerted.

INDUSTRIAL APPLICABILITY

As described above respectively, the present invention can be applied to a field of a sound pressure signal output apparatus, and a particularly significant effect can be obtained in a case in which the present invention is applied to a field of a sound pressure signal output apparatus outputting a sound pressure signal comparable to an internal combustion engine sound.

DESCRIPTION OF REFERENCE NUMERALS

1 sound waveform data
1A single sound data
1B random sound data
2 sound control data
2A order sound control data
10 processing apparatus
11 processing unit
12 interface
13 operation unit
14 display unit
15 loudspeaker
16 bus
110 plural-cylinder-sound generation unit
111 synthesis unit
C vehicle data
S sound pressure signal output apparatus
DB database

The invention claimed is:

1. A sound pressure signal output apparatus comprising:
a first acquisition means that acquires a single sound data, which is a sound data comparable to a sound generated from a cylinder of an internal combustion engine during one combustion cycle in the cylinder;
a second acquisition means that acquires an order sound data, which is a sound data comparable to an order sound, frequency of which corresponds to a rotation speed of the engine;
a third acquisition means that acquires a random sound data, which is a sound data comparable to a random sound generated to correspond to at least either a material or a shape of a structure constituting the engine due to operation of the engine; and
a synthesis means that synthesizes sound pressure signal for the single sound data acquired, a sound pressure signal for the order sound data acquired, and a sound pressure signal for the random sound data acquired to output a sound pressure signal for a sound of the engine.

2. The sound pressure signal output apparatus according to claim 1,
wherein the engine is a multi-cylinder engine,
wherein the first acquisition means acquires the respective single sound data comparable to sounds respectively generated from the respective cylinders during the one combustion cycle in the respective cylinders,
wherein the second acquisition means acquires the respective order sound data respectively corresponding to the respective cylinders, and
wherein the synthesis means delays the sound pressure signals for the single sound data acquired and the sound pressure signals for the order sound data acquired to match a combustion interval among the respective cylinders and synthesizes the sound pressure signals for the respective single sound data, the sound pressure signals for the respective order sound data and the sound pressure signal for the random sound data to output the sound pressure signal for the sound of the engine.

3. The sound pressure signal output apparatus according to claim 2,
wherein an amplitude magnification of at least either the sound pressure signal for the single sound data or the sound pressure signal for the order sound data differs per cylinder.

4. The sound pressure signal output apparatus according to claim 3,
wherein one of the single sound data comprises a plurality of single sound data by rotation speeds respectively corresponding to sounds generated during the combustion cycle at a plurality of different rotation speeds in the cylinder corresponding to the single sound data.

5. The sound pressure signal output apparatus according to claim 4, wherein the synthesis means synthesizes the sound pressure signals for the plurality of single sound data with the sound pressure signal for the order sound data and the sound pressure signal for the random sound data while cross-fading the sound pressure signals for the plurality of single sound data based on the rotation speeds.

6. The sound pressure signal output apparatus according to claim 3, wherein, as for the order sound data, one of the order sound data is formed by an order sound data at time of acceleration and an order sound data at time of deceleration.

7. The sound pressure signal output apparatus according to claim 3, wherein the synthesis means controls for synthesis the sound pressure signal for the single sound data, the sound pressure signal for the order sound data, and the sound pressure signal for the random sound data based on accelerator opening and rotation speed corresponding to the driving.

8. The sound pressure signal output apparatus according to claim 3, wherein the synthesis means further synthesizes at least any of a sound pressure signal for idling sound data comparable to an idling sound corresponding to the engine, a sound pressure signal for starter sound data comparable to a starter sound corresponding to the engine, a sound pressure signal for gear sound data comparable to a gear sound corresponding to the engine, a sound pressure signal for gear shift sound data comparable to a gear shift sound corresponding to the engine, a sound pressure signal for rev limiter sound data comparable to a rev limiter sound corresponding to the engine, and a sound pressure signal for afterfire sound data comparable to an afterfire sound corresponding to the engine to output the sound pressure signal for the sound of the engine.

9. The sound pressure signal output apparatus according to claim 2, wherein one of the single sound data comprises a plurality of single sound data by rotation speeds respectively corresponding to sounds generated during the combustion cycle at a plurality of different rotation speeds in the cylinder corresponding to the single sound data.

10. The sound pressure signal output apparatus according to claim 9, wherein the synthesis means synthesizes the sound pressure signals for the plurality of single sound data with the sound pressure signal for the order sound data and the sound pressure signal for the random sound data while cross-fading the sound pressure signals for the plurality of single sound data based on the rotation speeds.

11. The sound pressure signal output apparatus according to claim 2, wherein, as for the order sound data, one of the order sound data is formed by an order sound data at time of acceleration and an order sound data at time of deceleration.

12. The sound pressure signal output apparatus according to claim 2, wherein the synthesis means controls for synthesis the sound pressure signal for the single sound data, the sound pressure signal for the order sound data, and the sound pressure signal for the random sound data based on accelerator opening and rotation speed corresponding to the driving.

13. The sound pressure signal output apparatus according to claim 2, wherein the synthesis means further synthesizes at least any of a sound pressure signal for idling sound data comparable to an idling sound corresponding to the engine, a sound pressure signal for starter sound data comparable to a starter sound corresponding to the engine, a sound pressure signal for gear sound data comparable to a gear sound corresponding to the engine, a sound pressure signal for gear shift sound data comparable to a gear shift sound corresponding to the engine, a sound pressure signal for rev limiter sound data comparable to a rev limiter sound corresponding to the engine, and a sound pressure signal for afterfire sound data comparable to an afterfire sound corresponding to the engine to output the sound pressure signal for the sound of the engine.

14. The sound pressure signal output apparatus according to claim 1, wherein one of the single sound data comprises a plurality of single sound data by rotation speeds respectively corresponding to sounds generated during the combustion cycle at a plurality of different rotation speeds in the cylinder corresponding to the single sound data.

15. The sound pressure signal output apparatus according to claim 14, wherein the synthesis means synthesizes the sound pressure signals for the plurality of single sound data with the sound pressure signal for the order sound data and the sound pressure signal for the random sound data while cross-fading the sound pressure signals for the plurality of single sound data based on the rotation speeds.

16. The sound pressure signal output apparatus according to claim 1, wherein, as for the order sound data, one of the order sound data is formed by an order sound data at time of acceleration and an order sound data at time of deceleration.

17. The sound pressure signal output apparatus according to claim 1, wherein the synthesis means controls for synthesis the sound pressure signal for the single sound data, the sound pressure signal for the order sound data, and the sound pressure signal for the random sound data based on accelerator opening and rotation speed corresponding to the driving.

18. The sound pressure signal output apparatus according to claim 1, wherein the synthesis means further synthesizes at least any of a sound pressure signal for idling sound data comparable to an idling sound corresponding to the engine, a sound pressure signal for starter sound data comparable to a starter sound corresponding to the engine, a sound pressure signal for gear sound data comparable to a gear sound corresponding to the engine, a sound pressure signal for gear shift sound data comparable to a gear shift sound corresponding to the engine, a sound pressure signal for rev limiter sound data comparable to a rev limiter sound corresponding to the engine, and a sound pressure signal for afterfire sound data comparable to an afterfire sound corresponding to the engine to output the sound pressure signal for the sound of the engine.

19. A sound pressure signal output method of synthesizing and outputting a sound pressure signal for a sound of an internal combustion engine by means of a computer, comprising:

a step of acquiring a single sound data, which is a sound data comparable to a sound generated from one cylinder of the engine during one combustion cycle in the cylinder;

a step of acquiring an order sound data, which is a sound data comparable to an order sound, frequency of which corresponds to a rotation speed of the engine;

a step of acquiring a random sound data, which is a sound data comparable to a random sound generated to correspond to at least either a material or a shape of a structure constituting the engine due to operation of the engine; and a step of synthesizing a sound pressure signal for the single sound data acquired, a sound pressure signal for the order sound data acquired, and a sound pressure signal for the random sound data acquired to output the sound pressure signal for the sound of the engine.

20. A non-volatile recording medium recording a program for sound pressure signal output of an engine sound causing a computer to execute:

a step of acquiring a single sound data, which is a sound data comparable to a sound generated from one cylinder of an internal combustion engine during one combustion cycle in the cylinder;

a step of acquiring an order sound data, which is a sound data comparable to an order sound, frequency of which corresponds to a rotation speed of the engine;

a step of acquiring a random sound data, which is a sound data comparable to a random sound generated to correspond to at least either a material or a shape of a structure constituting the engine due to operation of the engine; and a step of synthesizing a sound pressure signal for the single sound data acquired, a sound pressure signal for the order sound data acquired, and a sound pressure signal for the random sound data acquired to output a sound pressure signal for a sound of the engine.

* * * * *